US009206630B2

(12) United States Patent
Kim

(10) Patent No.: US 9,206,630 B2
(45) Date of Patent: Dec. 8, 2015

(54) MAGNETIC CLOSURE FOR ELECTRONIC DEVICE CASES

(71) Applicant: Dae-Young Kim, Seoul (KR)

(72) Inventor: Dae-Young Kim, Seoul (KR)

(73) Assignee: SPIGEN KOREA CO, LTD., Geumcheon-Gu, Seoul (KR)

( * ) Notice: Subject to any disclaimer, the term of this patent is extended or adjusted under 35 U.S.C. 154(b) by 0 days.

(21) Appl. No.: 14/522,234

(22) Filed: Oct. 23, 2014

(65) Prior Publication Data

US 2015/0137533 A1 May 21, 2015

(30) Foreign Application Priority Data

Nov. 18, 2013 (KR) ..... 10-2013-0139960

(51) Int. Cl.
*E05C 17/56* (2006.01)
*E05C 19/16* (2006.01)

(52) U.S. Cl.
CPC ..... *E05C 19/16* (2013.01)

(58) Field of Classification Search
CPC ..... E05C 19/16
USPC ..... 292/251.5
See application file for complete search history.

(56) References Cited

U.S. PATENT DOCUMENTS

| | | | | | |
|---|---|---|---|---|---|
| 1,198,227 | A * | 9/1916 | Hinchey | 292/251.5 |
| 2,453,021 | A * | 11/1948 | Konelsky | 292/194 |
| 3,260,788 | A * | 7/1966 | Stetson | 174/374 |
| 3,749,301 | A * | 7/1973 | Peckar | 229/125.37 |
| 4,021,891 | A * | 5/1977 | Morita | 24/303 |
| 5,088,602 | A * | 2/1992 | Heyderman et al. | 206/387.13 |
| 5,944,368 | A * | 8/1999 | Hastings | 292/251.5 |
| 7,815,233 | B2 * | 10/2010 | Henry et al. | 292/251.5 |
| 2004/0183313 | A1 * | 9/2004 | Sherman et al. | 292/251.5 |
| 2005/0167992 | A1 * | 8/2005 | Lo et al. | 292/251.5 |
| 2006/0006674 | A1 * | 1/2006 | Kang et al. | 292/251.5 |
| 2007/0087263 | A1 * | 4/2007 | Ge et al. | 429/97 |
| 2008/0309098 | A1 * | 12/2008 | Hsu et al. | 292/251.5 |
| 2010/0124698 | A1 * | 5/2010 | Wu et al. | 429/100 |
| 2010/0134961 | A1 * | 6/2010 | Huang et al. | 361/679.01 |

FOREIGN PATENT DOCUMENTS

| | | | | |
|---|---|---|---|---|
| EP | 1520953 | A2 * | 4/2005 | E06B 3/28 |
| FR | 2914002 | A1 * | 9/2008 | E05D 11/10 |
| FR | 2968340 | * | 1/2011 | |
| GB | 2264975 | A * | 9/1993 | E05C 19/16 |

* cited by examiner

*Primary Examiner* — Carlos Lugo
(74) *Attorney, Agent, or Firm* — East West Law Group; Heedong Chae

(57) ABSTRACT

The magnetic closure for an electronic device case includes a first member detachably attached to an end of a front cover of the case and a second member directly or indirectly attached to a side wall of the electronic device such that the first and second members are magnetically attractable to each other for closing the front cover of the case onto the front surface of the electronic device. The first member is configured to form a clip structure, having a clip base extending to a bend portion and a clip arm extending back along the clip base from the bend portion wherein the clip arm is biased against the clip base. The first member further includes a sliding stopper which is formed by making a "⊏"-shaped hole on the clip base and bending up the part surrounded by the hole.

18 Claims, 8 Drawing Sheets

MAGNETIC CLOSURE FOR ELECTRONIC DEVICE CASES

CROSS-REFERENCE TO RELATED APPLICATIONS

This application claims the benefit of Korean Application No. 10-2013-0139960, filed on Nov. 18, 2013, with the Korean Intellectual Property Office, the contents of which are incorporated herein by reference.

FIELD OF THE INVENTION

The present invention relates in general to a magnetic closure for electronic device cases and, more particularly, to a magnetic closure for an electronic device having two magnetically attractable members attached to the case cover and/or the electronic device.

BACKGROUND OF THE INVENTION

Portable electronic devices, such as mobile phones, smart phones, tablet computers and the like, have become popular and widely used for communication, entertainment purposes and other purposes. These electronic devices are intended to be carried or moved about and as such, these devices are more likely to be accidentally dropped, hit, or scratched.

Protective cases are used in connection with the electronic devices such as cell phones, smart phones, tablet computers and the like. Due to the sensitive nature of these electronic devices, it is desirable to provide protection for these devices from impacts.

Among many types of mobile phones, bar type mobile phones have recently become very popular. Bar type mobile phones commonly have the screen and keypad on a single face. This structure of bar type mobile phones has made them particularly vulnerable to damages from being dropped or hit into. To protect such mobile phones, various types of cases have been developed and introduced to the market, including a case having a front flip cover.

In case of cell phone cases having a flip cover, there may or may not be a locking device to lock the flip cover to cover the front surface of a cell phone. If there is no locking device, the flip cover may become easily open to expose the screen of a cell phone or personal items secured in the case such as a credit card. Even if there is a locking device, the locking device has complex structure to make the case heavy and bulky and it is not easy for a user to quickly open the flip cover especially when the cell phone rings.

Therefore, to solve the above problems, a magnetic closure having a simple and slim structure of two magnetically attractable members attached to the case and/or the electronic device has been present for a long time considering the expansive demands in the everyday life. This invention is directed to solve these problems and satisfy the long-felt need.

SUMMARY OF THE INVENTION

The present invention contrives to solve the disadvantages of the prior art. The present invention provides a magnetic closure having two magnetically attractable members for an electronic device.

The object of the invention is to provide a magnetic closure for an electronic device case, having a first member detachably attached to an end of a front cover of the case and a second member attached to a side wall of the electronic device such that the first and second members are magnetically attractable to each other for closing the front cover of the case onto the front surface of the electronic device.

Another object of the invention is to provide a magnetic closure for an electronic device case, having magnetically attractable first and second members. The first member is detachably attached to an end of a front cover of the case and the second member is directly or indirectly attached to a side wall of the electronic device. The first member includes a clip base extending to a bend portion and a clip arm extending back along the clip base from the bend portion wherein the clip arm is biased against the clip base.

Still another object of the invention is to provide a magnetic closure for an electronic device case, having magnetically attractable first and second members. The first member is detachably attached to an end of a front cover of the case and the second member is directly or indirectly attached to a side wall of the electronic device. The first member includes a clip base extending to a bend portion and a clip arm extending back along the clip base from the bend portion wherein the clip arm is biased against the clip base. The first member further includes a sliding stopper which is formed by making a "ㄱ=" -shaped hole on the clip base and bending up the part surrounded by the hole.

Still another object of the invention is to provide a magnetic closure for an electronic device case, having magnetically attractable first and second members. The first member is configured to have a clip structure in order to be detachably attached to an end of a front cover of the case. The second member may be directly attached to a side wall of the electronic device, or alternatively, the second member may be indirectly attached by being attached to a side part of the case to cover the side of the electronic device or attached to a back cover of the case.

The advantages of the present invention are: (1) the magnetic closure of the present invention has a slim, compact and simple structure and it is light, durable and easy-to-use; (2) the protective sheet of the magnetic closure of the present invention prevents scratches or damages to the electronic device and the screen of the electronic device; (3) the front cover, when closed, of the electronic device case may be slightly open, but the magnetic closure of the present invention prevents such problem and provides a tight closure of the case; (4) the first member of the magnetic closure has a clip structure and thus, it is easy to attach or detach to and from the case; (5) the sliding stopper of the magnetic closure secures enough contact area between the first and second members for secure magnetic attraction between the first and second members; (6) because of the magnetic closure, it is easy and convenient to open and close the front cover of the case; and (7) the magnetic closure of the present invention provides enough closing force of the front cover to the case.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
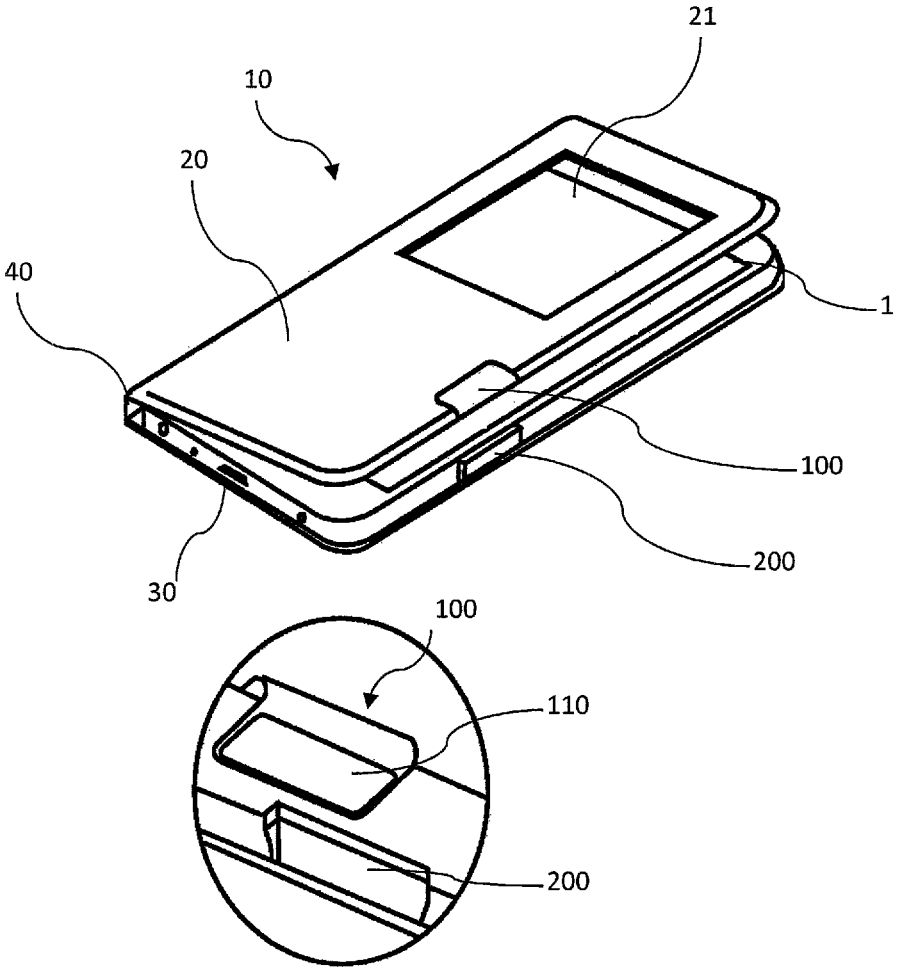
FIG. 1 shows a perspective view and an enlarged view of a magnetic closure attached to an electronic device and a case according to one embodiment of the present invention.

FIG. 1 shows a perspective view of a magnetic closure for an electronic device 1 of the present invention. The figure in a circle of FIG. 1 is an enlarged view of the magnetic closure. The electronic device 1 may be a smart phone, mobile phone, tablet PC, PDA, MP3 player, etc. The magnetic enclosure is attached to the electronic device 1.

The electronic device 1 is detachably attached to a case 10. The case 10 comprises a front cover 20, a back cover 30 and a case bend portion 40. The front cover 20 extends to the case bend portion 40 and the back cover 30 extends back along the front cover 20 from the case bend portion 40. The front cover 20 is to cover the front surface of the electronic device 1 where a screen is located. Furthermore, the front cover may include a window 21 which is transparent so that a user can see the screen of the electronic device 1 even when the front cover 20 is closed to cover the screen of the electronic device 1.

Preferably, the electronic device 1 is detachably attached to the back cover 30. The electronic device 1 may be directly or indirectly attached to the back cover 30. When indirectly attached, the case 10 may further include a housing or a frame which is attached to the back cover 30 in order to house the electronic device 1.

The magnetic closure of the present invention includes a first member 100 and a second member 200. The first member 100 is detachably attached to an end of the front cover 20 and the second member 200 is directly or indirectly attached to a side wall of the electronic device 1. When the electronic device 1 is housed in the housing or the frame, the second member 200 is attached to the side of the housing or the frame and thus, indirectly attached to the electronic device 1 which is detachably attached to the housing or the frame.

The first and second members 100 and 200 are magnetically attractable to each other for closing the front cover 20 of the case 10 onto the front surface of the electronic device 1. To make the members 100 and 200 magnetically attractable to each other, one of them 100 and 200 may include a magnet 50 and the other may be made of a ferromagnetic material such as iron or steel. The member 100 or 200 made of a ferromagnetic material such as iron or steel may be coated with chromium to prevent oxidation or surface corrosion, or alternatively, it may be made of stainless steel.

Figure 4A:
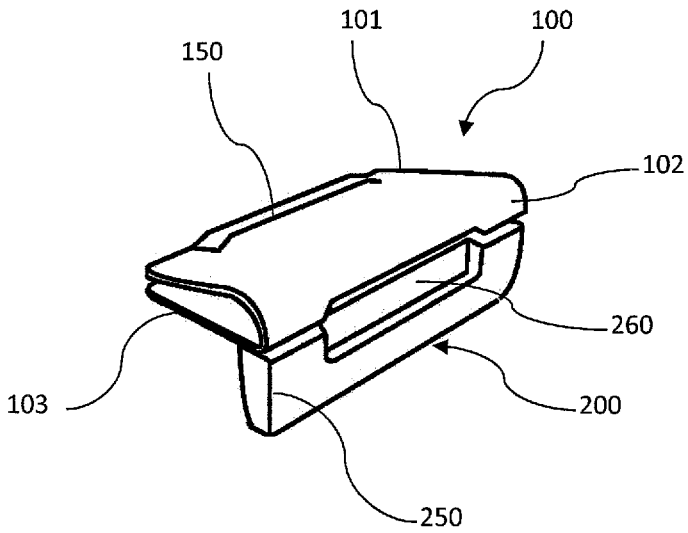
FIGS. 4(*a*) and 4(*b*) show perspective views of the magnetic closure according to another embodiment of the present invention.
Figure 4B:
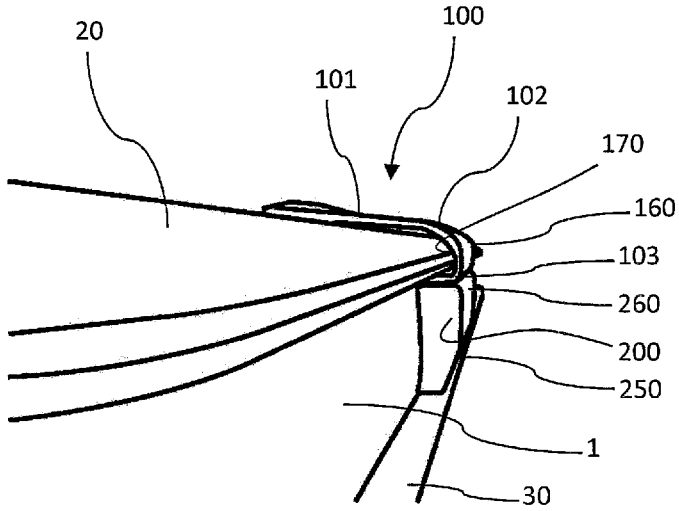

FIGS. 4(*a*) and 4(*b*) show perspective views of the magnetic closure according to one embodiment of the present invention. The first member 100 is detachably attached to an end of the front cover 20. The first member 100 is configured to form a clip structure, comprising a clip base 103 extending to a bend portion 102 and a clip arm 101 extending back along the clip base 103 from the bend portion 102. The clip arm 101 is biased against the clip base 103 and thus, when the first member 100 is inserted to the end of the front cover 20, the first member 100 can securely and tightly hold the end and does not slip out. The outer surface 250 of the second member 200 may be rounded as shown in FIG. 4(*a*), 4(*b*), or 5(*b*).

Figure 5A:
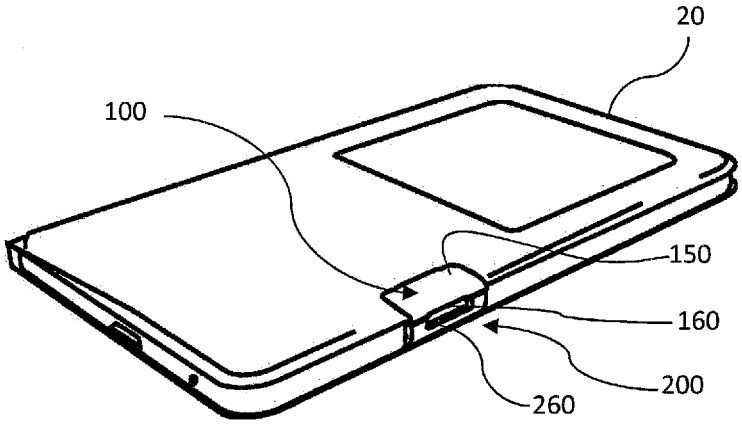
FIGS. 5(*a*) and 5(*b*) show a perspective view and a cross-sectional view of the magnetic closure according to the embodiment of FIG. 4.
Figure 5B:
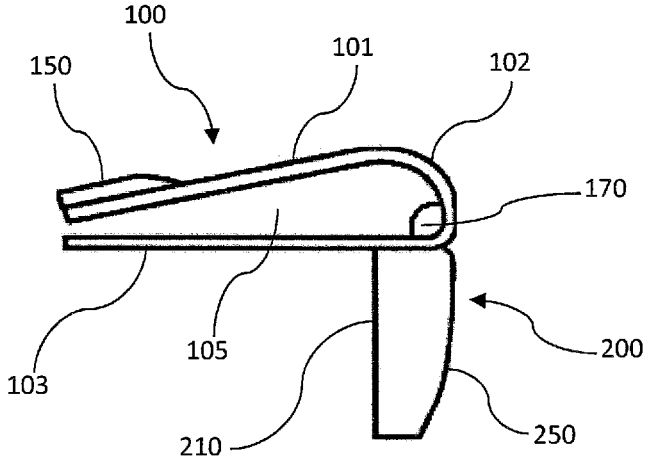

FIGS. 5(*a*) and 5(*b*) show a perspective view and a cross-sectional view of the magnetic closure according to the embodiment of FIG. 4. The first member 100 may further comprise a sliding stopper 170 to secure sufficient area of contact between the first and second members 100 and 200 when the first member 100 is inserted into the end of the front cover 20. Without the sliding stopper 170, the first member may be slid into the end of the front cover 20 so that the bend portion 102 is in contact with the end of the front cover 20, and there may not be enough area of contact between the first and second members 100 and 200.

Figure 8A:
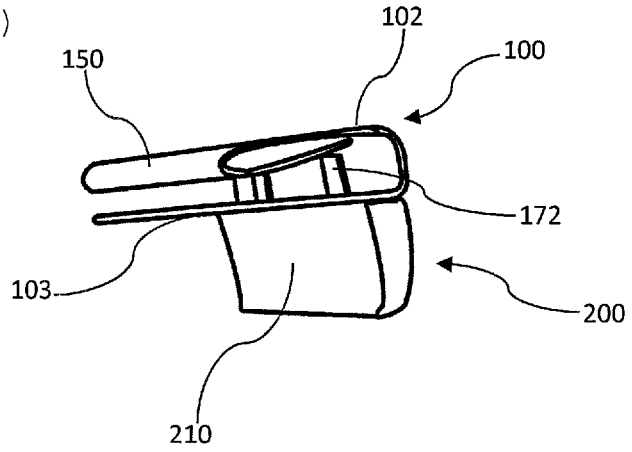
FIGS. 8(*a*)~(*c*) show perspective views of the magnetic closure according to still another embodiment of the present invention.
Figure 8B:
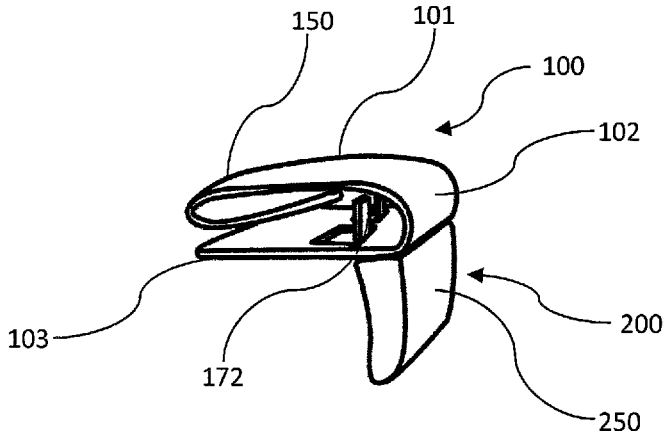
Figure 8C:
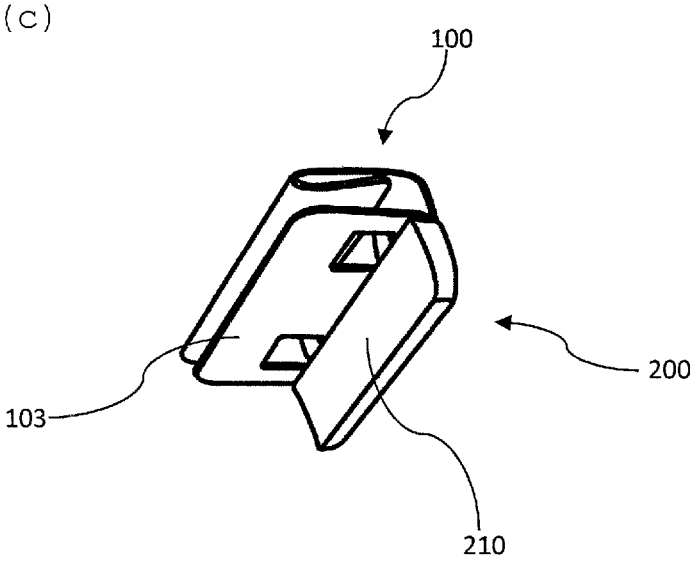

FIG. 8 shows another embodiment of the sliding stopper 170. In FIG. 5, the sliding stopper 170 is attached to the bend portion 102 and/or the clip base 103. However, in FIG. 8, the sliding stopper 170 is formed on the clip base 103 by making a lengthwise hole preferably in "n" shape on the clip base 103 and bending up the portion surrounded by the hole. The sliding stopper 170 may comprise two of such portions formed on the clip base 103. Preferably, the lengthwise hole is in the shape of "⊏ ", "⊏ " with the two corners rounded, an oval, a half circle, etc.

As shown in FIGS. 4 and 5, an end of the clip arm 101 may be upwardly recessed to form a holder 150. A user can lift up the holder 150 and slide the first member 100 to remove or detach the first member 100 from the end of the front cover 20.

Figure 6A:
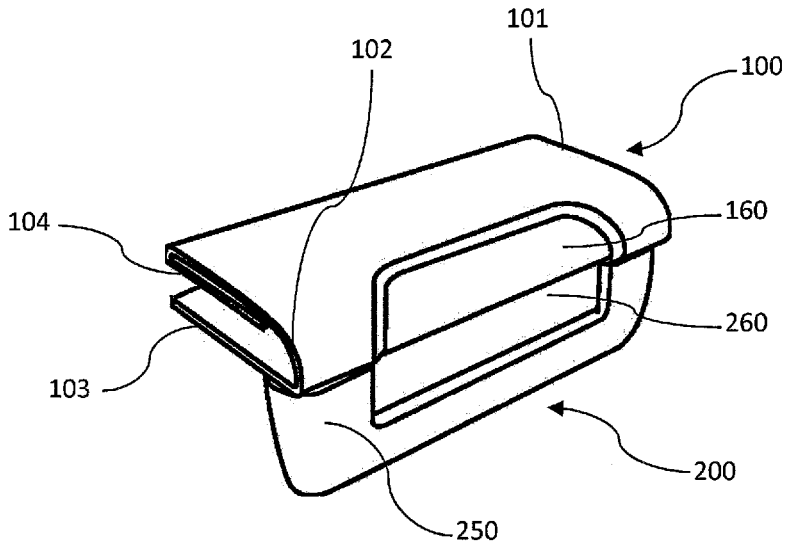
FIGS. 6(*a*) and 6(*b*) show perspective views of the magnetic closure according to still another embodiment of the present invention.
Figure 6B:
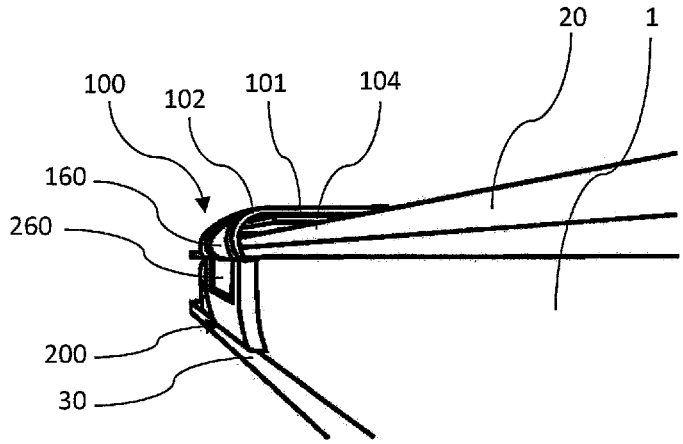

FIGS. 6(*a*) and 6(*b*) show perspective views of the magnetic closure according to another embodiment of the present invention. The first member 100 may further comprise an extending arm 104 extending from an end of the clip arm 101 back to the direction of the bend portion 102. Preferably, the extending arm 104 is below of the clip arm 101. Because of the extending arm 104, the clip arm side is thicker than the clip base 103 so that a user can easily stick in his fingernail between the clip arm 101 and the front cover 20 to lift up the clip arm 101 and slide out the first member 100. In addition, the clip arm 101 and the extending arm 104 make a rounded corner to prevent scratch or damage by the first member 100 to the front cover 20. The extending arm 104 also prevents the first member 100 from being slipped out of the front cover 20.

The first and second members 100 and 200 may further comprise respectively recesses 160 and 260 of the first and second members 100 and 200. Preferably, the recesses 160 and 260 form a continuous contour as shown in FIG. 6(*a*).

Figure 2A:
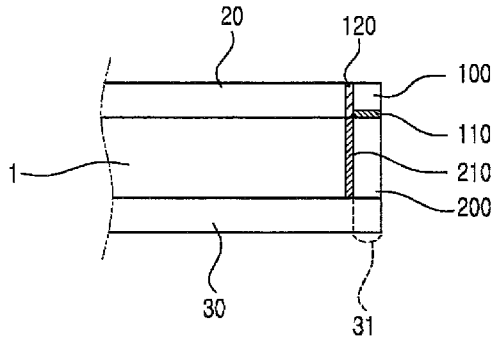
FIGS. 2(*a*)~(*c*) show schematic sectional views of the magnetic closure according to various embodiments of the present invention.
Figure 2B:
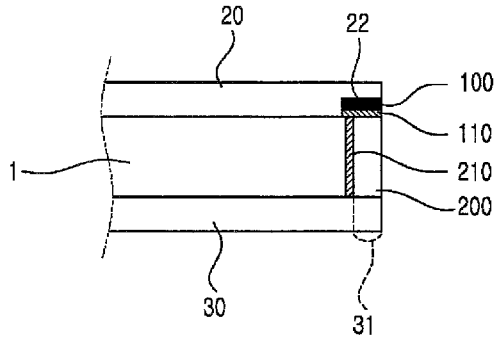
Figure 2C:
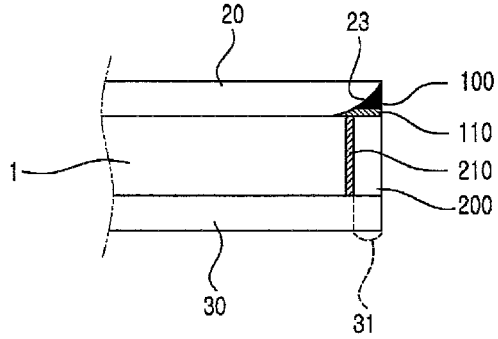

FIGS. 2(*a*)~(*c*) show schematic sectional views of the magnetic closure according to various embodiments of the present invention. The first member 100 may further comprise a protective sheet 110 attached to the bottom of the first member 100 so that the protective sheet 110 plays the role of bumper to prevent direct contact between the first and second members 100 and 200. Thus, the protective sheet 110 prevents scratches or damages to the electronic device 1 or its screen. Preferably, the protective sheet 110 is made of elastic material such as chamude, fabric, silicon, synthetic material, etc.

The first member 100 may further comprise a magnetic member made of magnetic material, or alternatively, the second member 200 may further comprise a magnetic member made of magnetic material.

FIGS. 2(*a*)~(*c*) show various embodiments of the present invention. In FIG. 2(*a*), the first member 100 is attached to the side of the front cover 20 by an adhesive material 120 and the second member 200 is attached to the electronic device 1 by an adhesive material 210. The back cover 30 is a little extended to provide an area 31 for the second member 200.

In FIG. 2(*b*), the front cover 20 comprises a first member receiving portion 22 to house the first member 100 and the protective sheet 110 is attached to the bottom of the first member 100. In FIG. 2(*c*), the first member receiving portion 23 is inclined and the first member is configured to correspond to the inclination of the first member receiving portion 23.

Figure 3A:
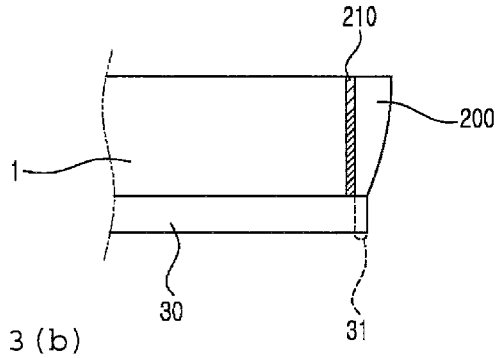
FIGS. 3(*a*)~(*c*) show schematic sectional views of the second member of the magnetic closure according to various embodiments of the present invention.
Figure 3B:
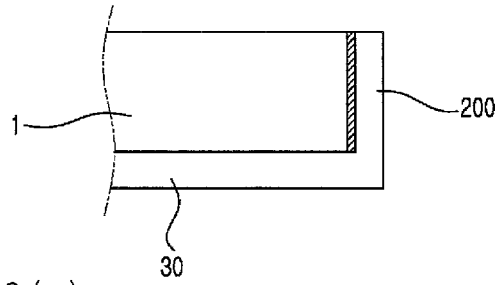
Figure 3C:
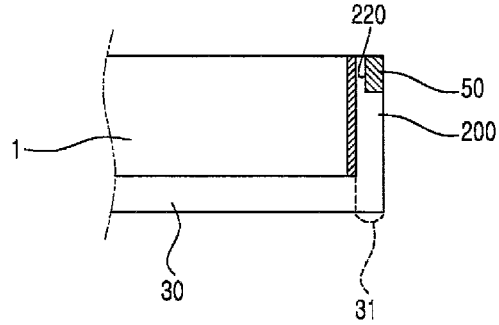

FIGS. 3(*a*)~(*c*) show schematic sectional views of the second member of the magnetic closure according to various embodiments of the present invention. In FIG. 3(*a*), the outer part of the second member 200 is curved to provide wider area of contact between the first and second members 100 and 200.

In FIGS. 3(*b*) and 3(*c*), the second member 200 is integrated into the back cover 30 and directly extended upwardly from the back cover 30. Furthermore, the second member 200 is attached to the side of the electronic device 1 by an adhesive material 210. In FIG. 3(*c*), a magnet 50 is received in the magnet housing 220 of the second member 200.

Figure 7:
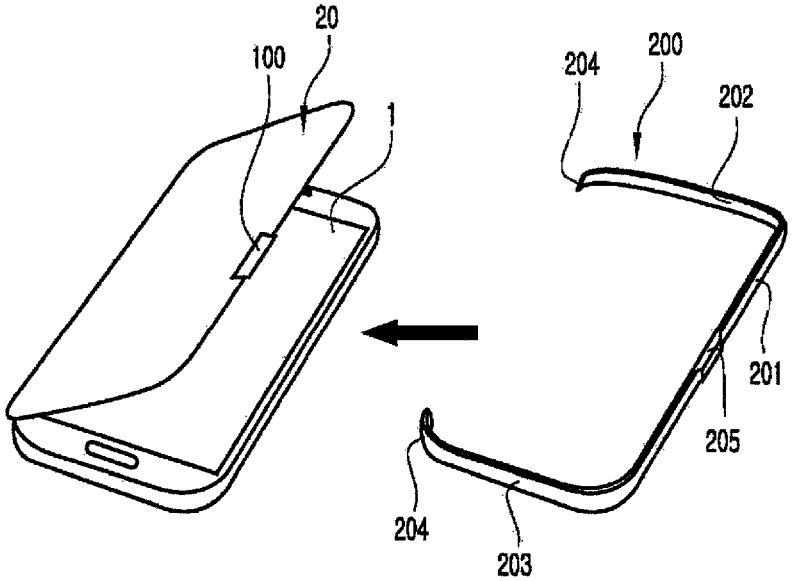
FIG. 7 shows a perspective view of the magnetic closure according to still another embodiment of the present invention.

FIG. 7 shows a perspective view of the magnetic closure according to still another embodiment of the present invention. The case 10 comprises a front cover 20 and a side covering frame. The side covering frame comprises a first part 201, a second part 202, and a third part 203. The ends 204 of the second and third parts 202 and 203 are curved so that the side covering frame can securely and tightly house the electronic device 1 therein. The case 10 may or may not further comprise a back cover 30. If there is a back cover 30, the side covering frame may be attached to the back cover 30.

In the embodiment of FIG. 7, the magnetic closure includes a first member 100, preferably detachably, attached to an end of the front cover 20 of the case, and a second member 200 attached to the side covering frame of the case 10. The second member 200 may be attached to the side covering frame, or alternatively, the second member 200 may be integrated into the side covering frame to be an integrated part of the first part 201. The first and second members 100 and 200 are magnetically attractable to each other for closing the front cover 20 of the case 10 onto the front surface of the electronic device 1.

The first member 100 comprises a clip base 103 extending to a bend portion 102, and a clip arm 101 extending back along the clip base 103 from the bend portion 102 wherein the clip arm 101 is biased against the clip base 103.

The first member 100 may further comprise a sliding stopper 170. The sliding stopper 170 is necessary to secure a enough contact area 205 on the second member 200. The sliding stopper 170 is formed by making a lengthwise hole, preferably in "ㄷ" shape, on the clip base 103 and bending up a plate 172 formed by the lengthwise hole. The lengthwise hole may be in a number of shapes such as "ㄷ" shape, an oval, a half circle, etc. When the hole is in "ㄱ" shape, the two corners of the hole may be rounded. In preferred embodiment, the lengthwise hole is in the shape of "ㄱ" with the two corners rounded.

The first member 100 may further comprise an extending arm 104 extending from an end of the clip arm 101 back toward the direction of the bend portion 102 as shown in FIG. 6.

In the embodiment of FIG. 7 when the second member 200 is integrated into the side covering frame, the magnetic closure comprises a first member 100 attached to an end of the front cover 20 of the case 10, and a second member 200 formed on the side covering frame of the case 10. The first and second members 100 and 200 are magnetically attractable to each other for closing the front cover 20 of the case 10 onto the front surface of the electronic device 1.

The first member 100 is detachably attached to the end of the front cover 20 and the first member 100 comprises a clip base 103 extending to a bend portion 102 and a clip arm 101 extending back along the clip base 103 from the bend portion 102 such that the clip arm 101 is biased against the clip base 103 to tightly hold the end of the front cover 20.

The first member 100 may further comprise a sliding stopper 170. The sliding stopper 170 is formed by making a lengthwise hole on the clip base 103 and bending up a plate 172 formed by the lengthwise hole as shown in FIGS. 8(*a*)~(*c*).

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A magnetic closure for an electronic device case, the case having a front cover to cover a front surface of an electronic device, the magnetic closure comprising:

a first member attached to an end of the front cover of the case; and a second member attached to a side wall of the electronic device;

wherein the first and second members are magnetically attractable to each other for closing the front cover of the case onto the front surface of the electronic device, wherein the first member is detachably attached to the end of the front cover, the first member comprising:

a clip base extending to a bend portion; and a clip arm extending back along the clip base from the bend portion wherein the clip arm is biased against the clip base.

2. The magnetic closure of claim 1, wherein the first member further comprises a sliding stopper.

3. The magnetic closure of claim 2, wherein the sliding stopper is formed by making a lengthwise hole on the clip base and bending up a plate formed by the lengthwise hole.

4. The magnetic closure of claim 3, wherein the lengthwise hole has two corners.

5. The magnetic closure of claim 1, wherein an end of the clip arm is recessed to form a holder.

6. The magnetic closure of claim 1, wherein the first member further comprises an extending arm extending from an end of the clip arm hack toward the bend portion.

7. The magnetic closure of claim 1, wherein the first member further comprises a protective sheet attached to the clip base.

8. The magnetic closure of claim 1, wherein the first member further comprises a magnetic member made of magnetic material.

9. The magnetic closure of claim 1, wherein the second member further comprises a magnetic member made of magnetic material.

10. The magnetic closure of claim 1, wherein the second member comprises a recess of the second member formed thereon.

11. The magnetic closure of claim 10, wherein the first member comprises a recess of the first member formed thereon, and wherein the recesses of the first and second members form a continuous contour.

12. A magnetic closure for an electronic device case, the case having a front cover to cover a front surface of an electronic device and a side covering frame to cover sides of the electronic device, the magnetic closure comprising:

a first member attached to an end of the front cover of the case; and a second member attached to the side covering frame of the case;

wherein the first and second members are magnetically attractable to each other for closing the front cover of the case onto the front surface of the electronic device, wherein the first member is detachably attached to the end of the front cover, the first member comprising:

a clip base extending to a bend portion; and a clip arm extending back along the clip base from the bend portion wherein the clip arm is biased against the clip base.

13. The magnetic closure of claim 12, wherein the first member further comprises a sliding stopper.

14. The magnetic closure of claim 13, wherein the sliding stopper is formed by making a lengthwise hole on the clip base and bending up a plate formed by the lengthwise hole and the lengthwise hole has two corners.

15. The magnetic closure of claim 12, wherein the first member further comprises an extending arm extending from an end of the clip arm back toward the bend portion.

16. A magnetic closure for an electronic device case, the case having a front cover to cover a front surface of an electronic device and a side covering frame to cover sides of the electronic device, the magnetic closure comprising:

a first member attached to an end of the front cover of the case; and a second member formed on the side covering frame of the case;

wherein the first and second members are magnetically attractable to each other for closing the front cover of the case onto the front surface of the electronic device, wherein the first member is detachably attached to the end of the front cover, the first member comprising:

a clip base extending to a bend portion; and a clip arm extending back along the clip base from the bend portion wherein the clip arm is biased against the clip base.

17. The magnetic closure of claim 16, wherein the first member further comprises a sliding stopper, and wherein the sliding stopper is formed by making a lengthwise hole on the clip base and bending up a plate formed by the lengthwise hole and the lengthwise hole has two corners.

18. A magnetic closure for an electronic device case, the case having a front cover to cover a front surface of an electronic device, the magnetic closure comprising:

a first member attached to an end of the front cover of the case; and a second member attached to a side wall of the electronic device;

wherein the first and second members are magnetically attractable to each other for closing the front cover of the case onto the front surface of the electronic device, wherein the first member comprises a recess of the first member formed thereon, wherein the second member comprises a recess of the second member formed thereon, and wherein the recesses of the first and second members form a continuous contour.

* * * * *